US009625242B1

(12) United States Patent
Elalem et al.

(10) Patent No.: US 9,625,242 B1
(45) Date of Patent: Apr. 18, 2017

(54) IGNITER FOR MODULAR ARTILLERY CHARGE SYSTEM

(71) Applicants: Mohamed Elalem, East Orange, NJ (US); Gregory C. Burke, Hanover, NH (US); Viral Panchal, Parlin, NJ (US); Philip Abbate, Long Valley, NJ (US); Chong Peng, Harrison, NJ (US); Fei Shen, North Arlington, NJ (US)

(72) Inventors: Mohamed Elalem, East Orange, NJ (US); Gregory C. Burke, Hanover, NH (US); Viral Panchal, Parlin, NJ (US); Philip Abbate, Long Valley, NJ (US); Chong Peng, Harrison, NJ (US); Fei Shen, North Arlington, NJ (US)

(73) Assignee: The United States of America as Represented by the Secretary of the Army, Washington, DC (US)

( * ) Notice: Subject to any disclaimer, the term of this patent is extended or adjusted under 35 U.S.C. 154(b) by 180 days.

(21) Appl. No.: 14/620,796

(22) Filed: Feb. 12, 2015

(51) Int. Cl.
*F42B 5/38* (2006.01)

(52) U.S. Cl.
CPC ..... *F42B 5/38* (2013.01)

(58) Field of Classification Search
CPC .. F42B 5/38; F42B 5/188; F42B 5/192; F42B 5/18
USPC ..... 102/202, 431, 282, 700, 435, 530
See application file for complete search history.

(56) References Cited

U.S. PATENT DOCUMENTS 3,176,617 A * 4/1965 Brafford ..... F42B 5/025 102/282
4,363,273 A * 12/1982 Luebben ..... F42B 5/196 102/290
4,572,076 A * 2/1986 Politzer ..... F42B 5/16 102/431
4,702,167 A * 10/1987 Reinelt ..... F42C 19/085 102/282
5,052,304 A * 10/1991 Rahnenfuhrer ..... F42B 5/181 102/431
5,151,557 A * 9/1992 Bracuti ..... F42B 5/24 102/435
5,218,166 A * 6/1993 Schumacher ..... C06B 25/18 102/431
5,269,224 A * 12/1993 Gonzales ..... F42B 5/16 102/275.11
5,454,323 A * 10/1995 Conil ..... F42B 5/188 102/282
5,463,956 A * 11/1995 Harting ..... F42B 5/24 102/282
5,565,643 A * 10/1996 Raines ..... F42B 5/24 102/289
5,672,842 A * 9/1997 Brion ..... F42B 5/38 102/282

(Continued)

*Primary Examiner* — Michael David
(74) *Attorney, Agent, or Firm* — Lisa H. Wang

(57) ABSTRACT

A modular artillery charge system module includes a central igniter container and cap end and body end igniter containers fixed to the central igniter container. The central igniter container is a rigid, longitudinal tube with opposing ends. The end igniter containers are fixed to the opposing ends of the central igniter container. Each end igniter container includes a large container portion and a small container portion that extends from the large container portion toward the central igniter container. The central igniter container and end igniter containers are made of a rigid material, such as foamed celluloid.

20 Claims, 8 Drawing Sheets

(56) References Cited

U.S. PATENT DOCUMENTS

| | | | | |
|---|---|---|---|---|
| 5,747,723 | A | 5/1998 | Buckalew | |
| 6,305,288 | B1 * | 10/2001 | Nilsson | F42B 5/38 102/288 |
| 6,343,552 | B1 * | 2/2002 | Harris | F42B 5/192 102/282 |
| 6,360,666 | B1 * | 3/2002 | Harris | F42B 33/02 102/282 |
| 6,382,104 | B1 * | 5/2002 | Peters | F42B 5/38 102/282 |
| 6,415,715 | B1 * | 7/2002 | Nilsson | F42B 5/38 102/201 |
| 7,546,804 | B1 * | 6/2009 | Tartarilla, III | F42B 3/113 102/201 |
| 8,015,923 | B2 * | 9/2011 | Caillaut | F42B 5/181 102/431 |
| 8,597,444 | B1 * | 12/2013 | Young | C06B 23/002 149/108.4 |
| 8,881,634 | B1 * | 11/2014 | Worrell, Jr. | F42B 5/188 86/10 |
| 9,273,942 | B1 * | 3/2016 | Burke | F42B 5/08 |
| 9,377,277 | B1 * | 6/2016 | Worrell, Jr. | F42B 5/067 |

* cited by examiner

IGNITER FOR MODULAR ARTILLERY CHARGE SYSTEM

STATEMENT OF GOVERNMENT INTEREST

The inventions described herein may be manufactured, used and licensed by or for the United States Government.

BACKGROUND OF THE INVENTION

The invention relates in general to munitions and in particular to modular artillery charge systems.

A modular artillery charge system (MACS) includes a three-piece combustible cartridge case design and a bi-directional center core ignition system. U.S. Pat. No. 5,747,723 issued on May 5, 1998 to Buckalew et al. discloses a MACS. The contents of U.S. Pat. No. 5,747,323 are incorporated by reference herein. FIG. 1 is a cross-sectional view of a MACS module 10 disclosed in U.S. Pat. No. 5,747,723.

Module 10 includes a body 12, a center core tube 14, and a cap 16. Body 12 and cap 16 each have the general shape of a thin-walled hollow cylinder with an open end and a closed end. Cap 16 fits into and covers the open end of body 12. The closed ends of both cap 16 and body 12 have center holes 32, 30, respectively. Center core tube 14 is positioned longitudinally in body 12 and contacts both cap 16 and the closed end of body 12. The cavity formed by assembly of propelling charge module 10 is filled with an energetic material 18. Exterior surfaces of body 12 and cap 16 are coated with an environmental protection material 20.

Center core tube 14 holds a core igniter bag 22. Core igniter bag 22 contacts two end igniter bags 24 and 26. End igniter bag 24 occupies the center hole 30 in the closed end of body 12 and end igniter bag 26 occupies the center hole 32 in cap 16. End igniter bags 24 and 26 may be held in place by an attaching means 28.

The closed end of the body 12 at its center hole 30 has a conical surface 34 joined to a flat surface 36 joined to a tubular surface 38. Similarly, the closed end of cap 16 at its center hole 32 has a conical surface 40 joined to a flat surface 42 joined to a tubular surface 44.

The igniter bags 22, 24, 26 in the MACS module 10 are made of a rayon/viscose material. The rayon/viscose material is a flexible, non-rigid fabric. The design and manufacturing of the igniter bags is very labor intensive. The manufacture of the igniter bags involves manually sewing the rayon/viscose material. In addition, attaining the desired quality control from lot to lot is difficult. Thus, there are an excessive amount of rejects and scrapped parts. Igniter bags that deviate from the quality control standards pose serious threats, for example, hangfire, misfire and other performance related issues, when loaded in a MACS supported system and then ignited in a gun tube.

A need exists for an improvement of the MACS igniter system that is safer and efficiently mass produced. The improvement should yield consistent tolerances, reliability and performance to thereby mitigate potential hazards.

SUMMARY OF INVENTION

One aspect of the invention is an artillery charge system module having a central longitudinal axis. The module includes a hollow, cylindrical combustible body having an open end and a closed end with a center hole. The closed end of the body at the center hole has a conical surface joined to a flat surface joined to a tubular surface. A core tube having first and second open ends is centered on the central longitudinal axis. A hollow, cylindrical, combustible cap has an open end and a closed end with a center hole. The open end of the cap is concentrically attached to the open end of the body. The closed end of the cap at the cap center hole has a conical cap surface joined to a flat cap surface joined to a tubular cap surface.

A rigid, core igniter container is disposed in the core tube. A rigid, body end igniter container is disposed in the closed end of the body in juxtaposition with the conical surface. A rigid, cap end igniter container is disposed in the closed end of the cap in juxtaposition with the conical cap surface. The cap end and body end igniter containers are fixed to the core igniter container.

The core igniter container, cap end igniter container and body end igniter container may be made of, for example, foamed celluloid.

The invention will be better understood, and further objects, features and advantages of the invention will become more apparent from the following description, taken in conjunction with the accompanying drawings.

BRIEF DESCRIPTION OF THE DRAWINGS

In the drawings, which are not necessarily to scale, like or corresponding parts are denoted by like or corresponding reference numerals.

DETAILED DESCRIPTION

Figure 1:
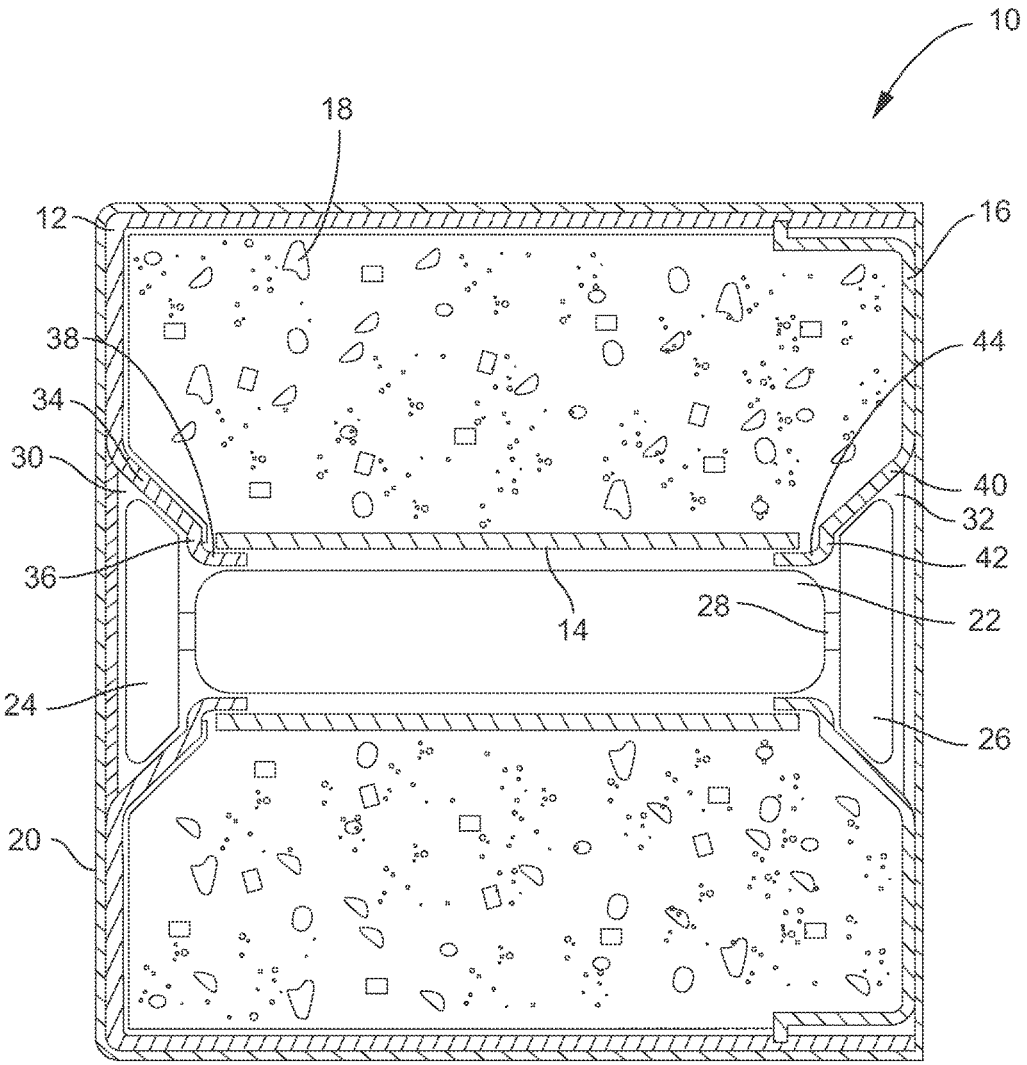
FIG. 1 PRIOR ART
FIG. 1 is a cross-sectional view of a known MACS module.

Novel igniter containers for a MACS 10 replace the prior art igniter bags 22, 24, 26 shown in FIG. 1. The novel igniter containers are made of a rigid material. One example of a material for the novel igniter containers is foamed celluloid, such as the foamed celluloid disclosed in U.S. Pat. No. 8,597,444 issued on Dec. 3, 2013 to Young et al. The contents of U.S. Pat. No. 8,597,444 are incorporated by reference herein.

Figure 2:
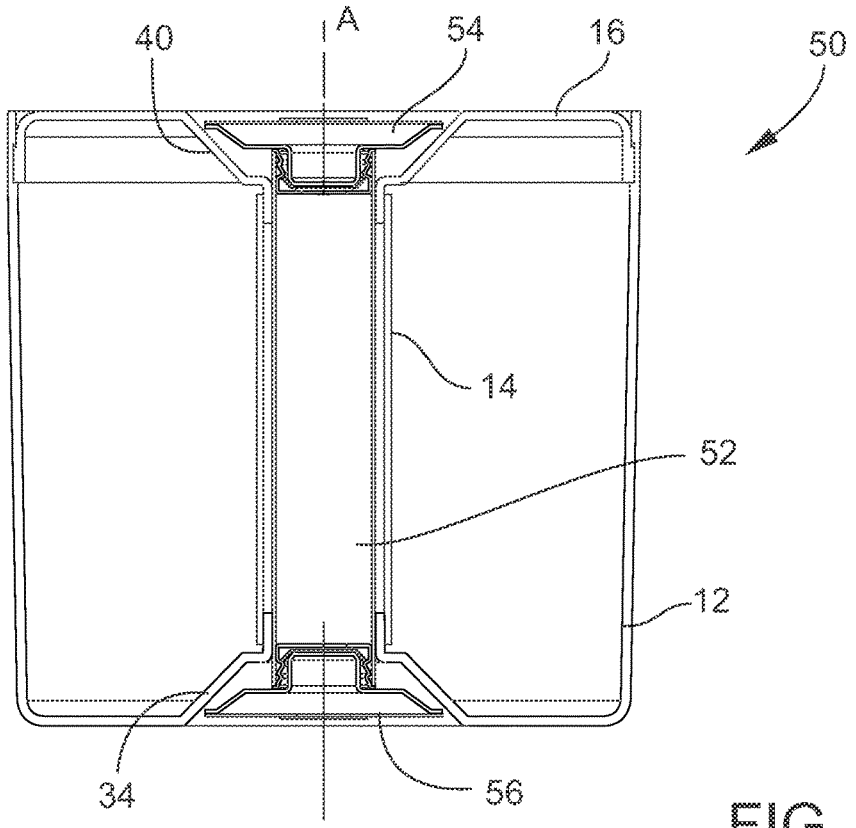
FIG. 2 is a cut away view of one embodiment of a novel MACS module.

FIG. 2 is a cutaway view of one embodiment of a novel MACS ignition system 50 having a longitudinal axis A, a rigid core igniter container 52 and rigid end igniter containers 54, 56. Rigid core igniter container 52 is disposed in the center core tube 14. Rigid body end igniter container 56 is disposed in the closed end of the body 12 in juxtaposition with the conical surface 34. Rigid cap end igniter container 54 is disposed in the closed end of the cap 16 in juxtaposition with the conical cap surface 40. The core igniter container 52, cap end igniter container 54 and body end igniter container 56 are made of foamed celluloid. The cap end and body end igniter containers 54, 56 are fixed to the core igniter container 52.

The core igniter container 52 and the end igniter containers 54, 56 contain propellant powders. In one embodiment, the core igniter container 52 contains ball powder and the cap end and body end igniter containers 54, 56 contain black powder. Of course, other types of propellants may be used.

Figure 3:
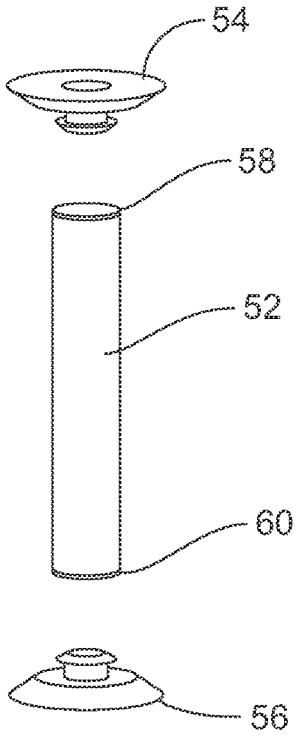
FIG. 3 is a perspective view of the igniter containers in the module of FIG. 2.
Figure 4:
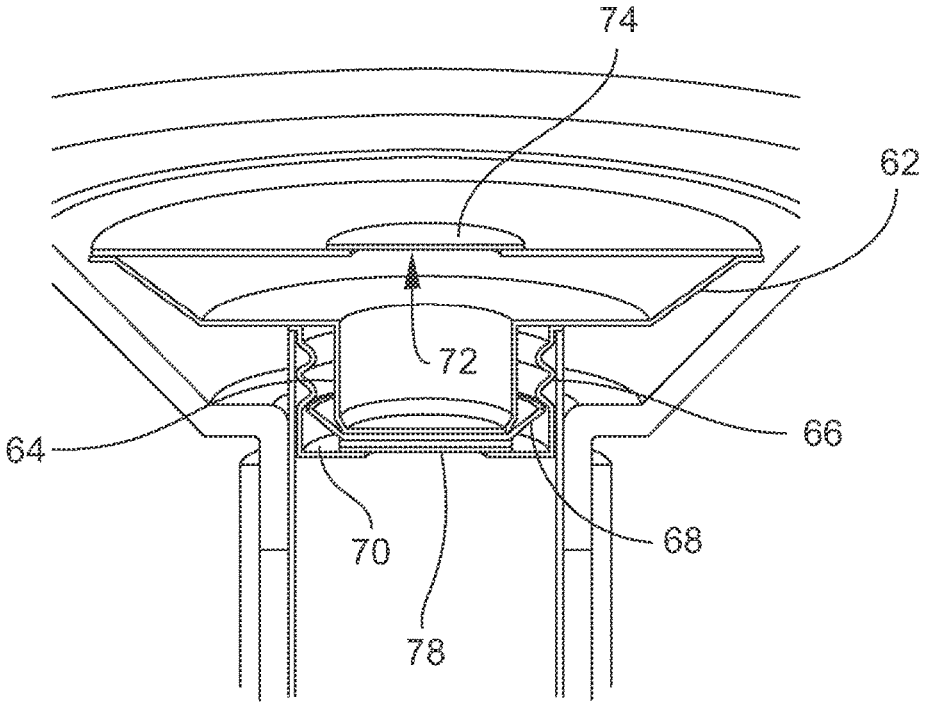
FIG. 4 is an enlarged, cutaway view of a portion of the module of FIG. 2.
Figure 5:
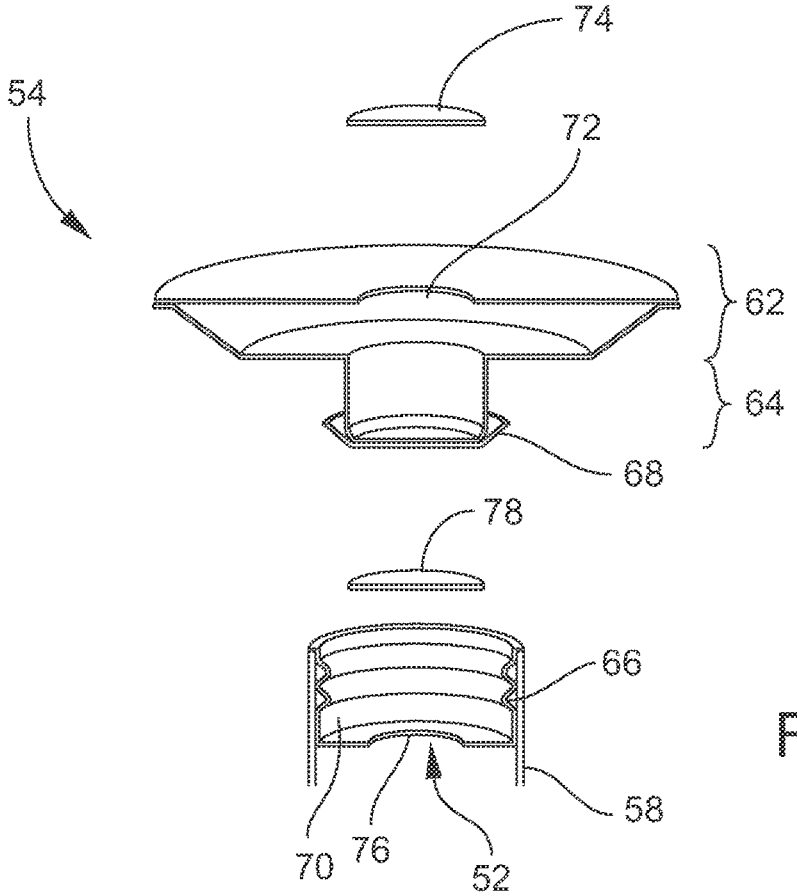
FIG. 5 is a cutaway, exploded view of an end igniter container and a portion of a core igniter container.

In one embodiment, core igniter container 52 is a rigid tube having a cap end 58 and a body end 60 (FIG. 3). Internal surfaces of the core igniter container 52 at the cap end 58 and the body end 60 include ridges 66 (FIGS. 4 and 5). The body end and cap end igniter containers 56, 54 each have a large container portion 62 and a small container portion 64 that extends from the large container portion 62 into a respective end of the core igniter container 52. The small container portions 64 include a flange 68 that mechanically locks beneath the ridges 66 in the internal surfaces of the core igniter container 52.

In one embodiment, the large container portion 62 is a conical frustum and the small container portion 64 is tubular, and the core igniter container 52 is a circular tube.

A plug 70 is inserted in each end of the core igniter container 52. Plug 70 has a receptacle for receiving the small container portion 64 of the end igniter containers 56, 54. The ridges 66 are formed on the receptacle of plug 70. The body end and cap end igniter containers 56, 54 each have a propellant loading hole 72 and a closure 74 for sealing the propellant loading hole 72. Closures 74 may be made of transparent materials, for example, unfoamed transparent celluloid sheet. Transparent celluloid enables laser light to pass through the closures 74 and ignite the powder. At least one of the plugs 70 inserted in the core igniter container 52 may include a propellant loading hole 76 and a closure 78 for sealing the propellant loading hole 76.

Figure 6:
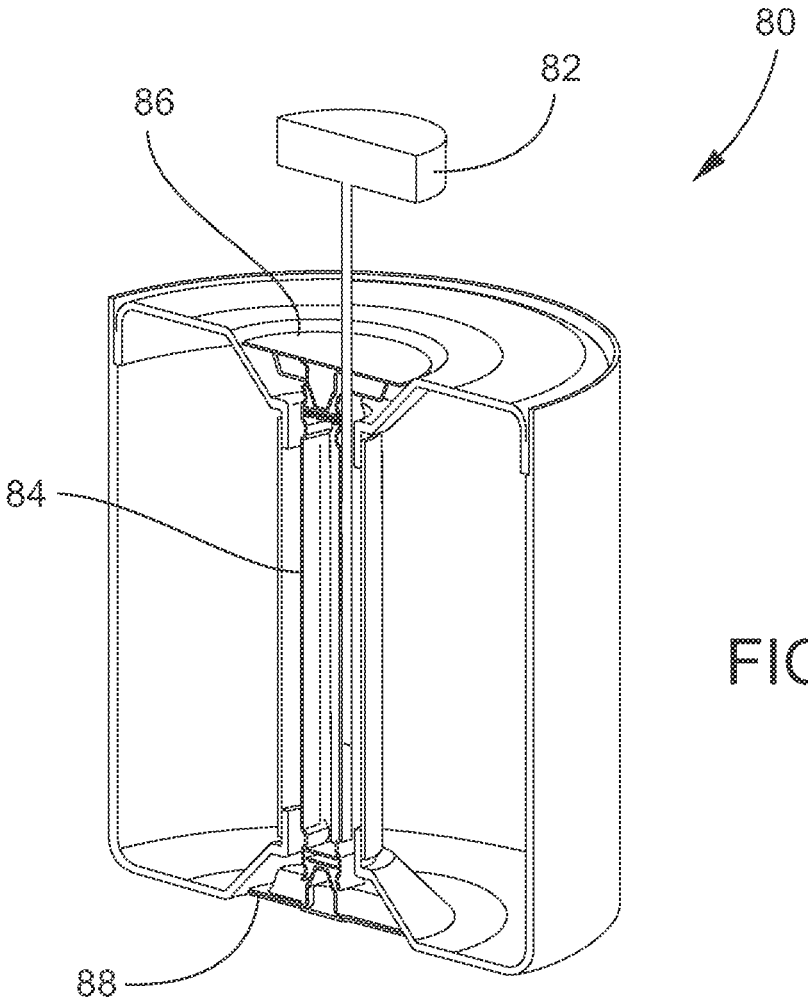
FIG. 6 is a cutaway, perspective view of another embodiment of a novel MACS module.
Figure 7:
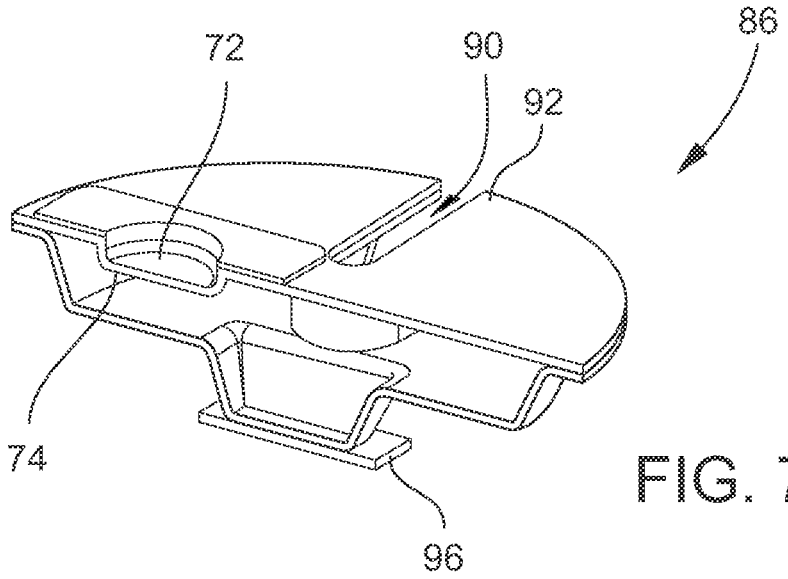
FIG. 7 is a cutaway, perspective view of an end igniter container in the module of FIG. 6.
Figure 8:
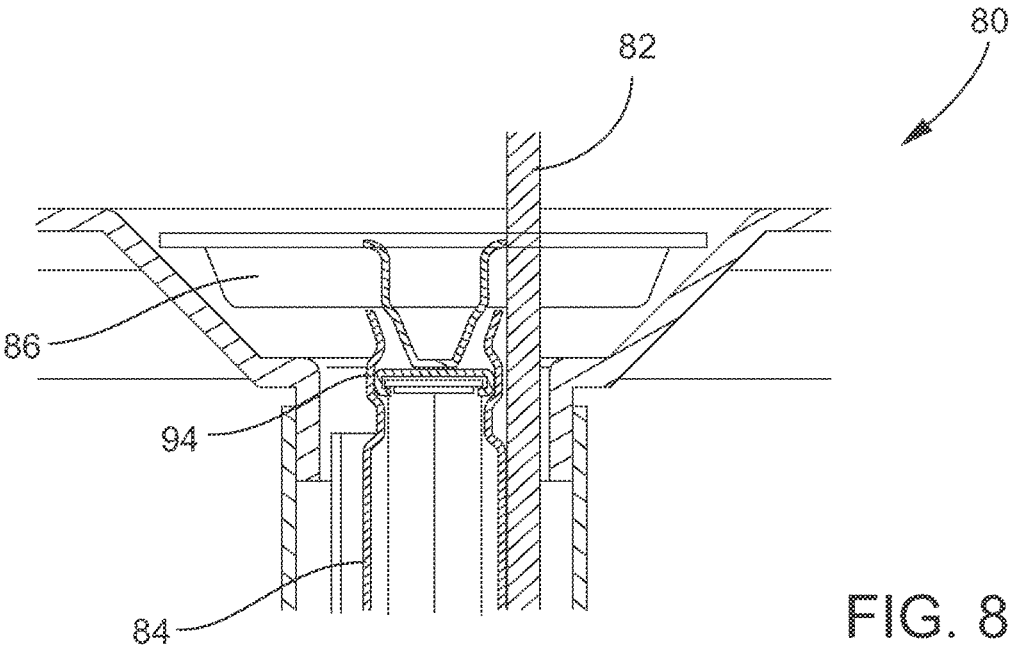
FIG. 8 is a sectional view of a portion of the module of FIG. 6.

FIG. 6 is a cutaway, perspective view of another embodiment of a novel MACS module 80. The core igniter container 84 and one of the cap end igniter container 86 and body end igniter container 88 are configured to accept a traditional mechanical temperature probe 82. The temperature probe 82 measures the temperature of the interior of the module 80. FIG. 7 is a cutaway, perspective view of end igniter container 86. Container 86 includes a radial slot 90 formed therein. Slot 90 extends radially inward from an outer edge 92 of container 86. The portion of container 86 that is not shown in FIG. 7 can be identical to the portion shown, so that another radial slot 90 exists opposite radial slot 90 seen in FIG. 7. The propellant loading hole 72 and closure 74 are located off center due to the presence of slot(s) 90.

Figure 9:
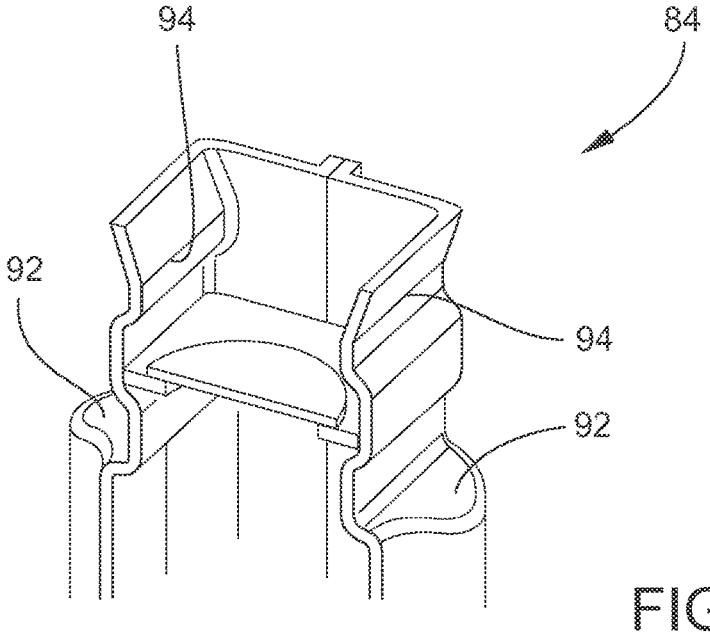
FIG. 9 is a cutaway, perspective view of a portion of a core igniter container in the module of FIG. 6.

As seen in FIG. 9, the core igniter container 84 may be a rectangular tube and include one or more longitudinal pockets 92 formed on its sides. The temperature probe 82 may be inserted through radial slot 90 and into longitudinal pocket 92. Container 84 includes ridges 94 at its ends for locking with end containers 86, 88.

Figure 10:
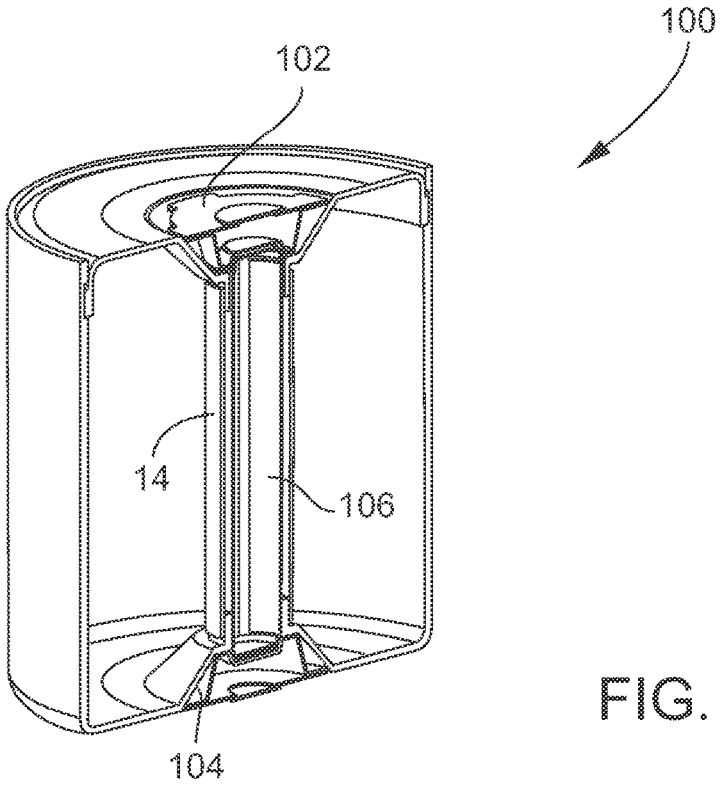
FIG. 10 is a cutaway, perspective view of another embodiment of a novel MACS module.
Figure 11:
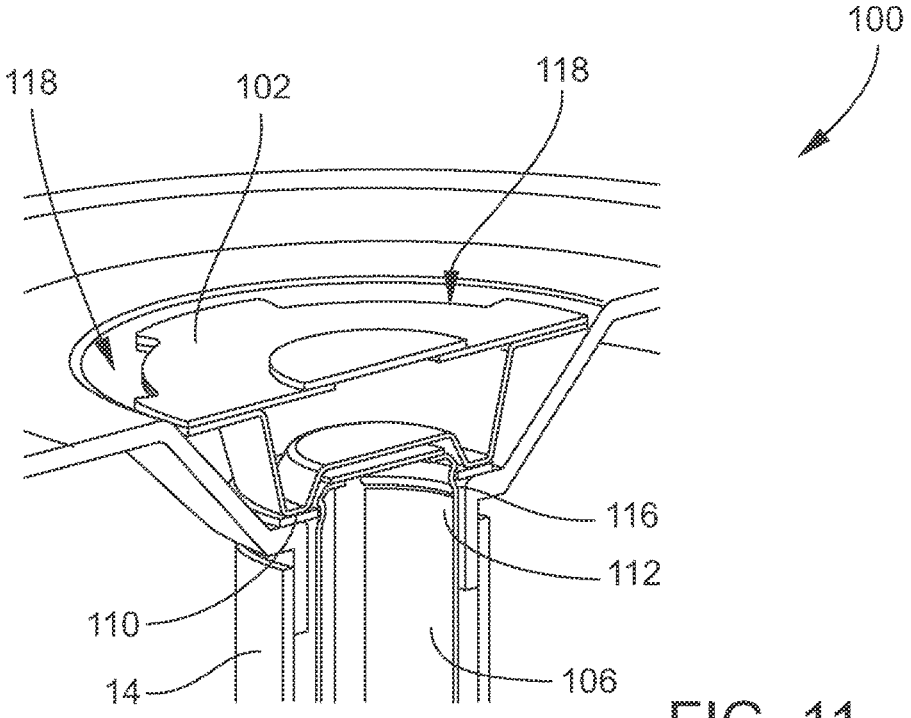
FIG. 11 is an enlarged view of a portion of the module of FIG. 10.
Figure 12:
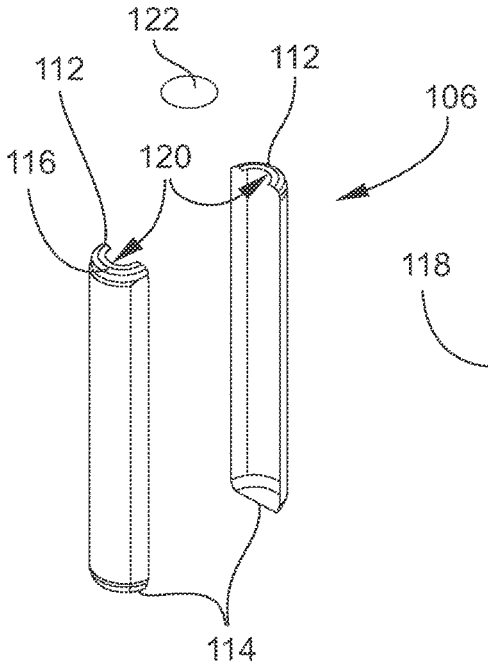
FIG. 12 is an exploded view of a core igniter container for the module of FIG. 10.
Figure 13:
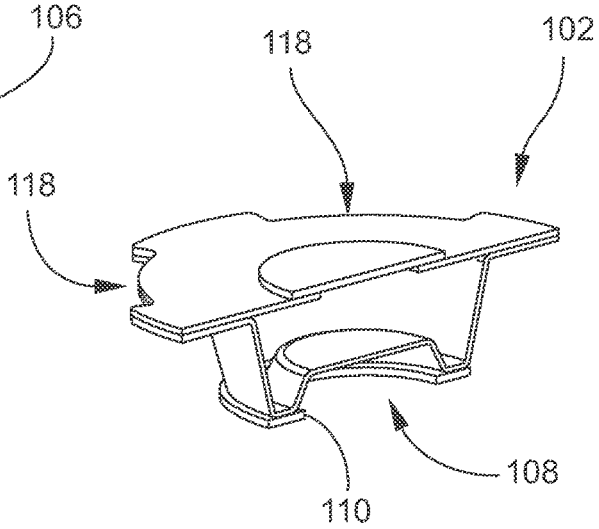
FIG. 13 is a cutaway, perspective view of an end igniter container for the module of FIG. 10.

FIG. 10 is a cutaway, perspective view of another embodiment of a novel MACS ignition system module 100. Module 100 includes body and cap end igniter containers 104, 102 and a core igniter container 106. The body end and cap end igniter containers 104, 102 are each generally frusto-conical in shape (FIG. 13) and include a receptacle 108 on a side facing the core igniter container 106. A flange 110 extends around and partially into the receptacle 108. The core igniter container 106 is a rigid tube having a cap end 112 and a body end 114. The external surfaces of the core igniter container 106 at the cap end 112 and the body end 114 include ridges 116.

The cap and body ends 112, 114 of the core igniter container 106 extend into the receptacles 108 of the cap end and body end igniter containers 102, 104 respectively. This construction enables the volume of the core igniter container 106 to be larger, compared to the construction of module 50. The flanges 110 on the cap and body end containers 102, 104 mechanically lock in the ridges 116 on the external surface of the core igniter container 106.

The sides of the cap end and body end igniter containers 102, 104 that are opposite the core igniter container 106 have channels 118 formed therein. The channels 118 are formed in the periphery of the top side surface of the cap and body end igniter containers 102, 104. Four channels 118 are present in the embodiment shown. The channels 118 enable gas generated by powder in the core igniter container 106 to pass through channels 118 and reach an adjacent MACS for sequential ignition. To facilitate gas flow, the diameter or transverse major dimension of the core igniter container 106 may be decreased to create a gap between the core igniter container 106 and the center core tube 14. One of the cap end and the body end 112, 114 of the core igniter container includes a propellant loading hole 120. A closure 122 seals the propellant loading hole 120.

Figure 14:
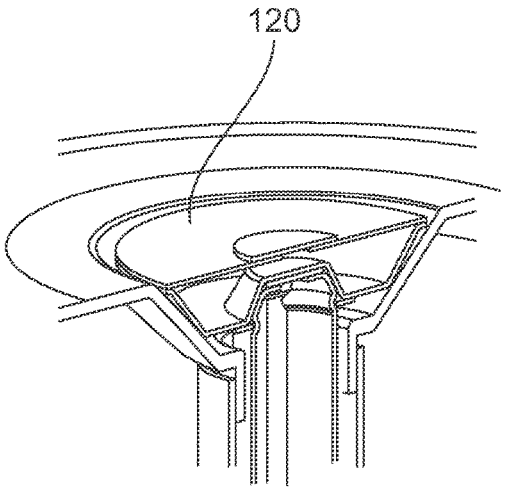
FIG. 14 is a cutaway, perspective view of a variation of the MACS module of FIG. 10.
Figure 15:
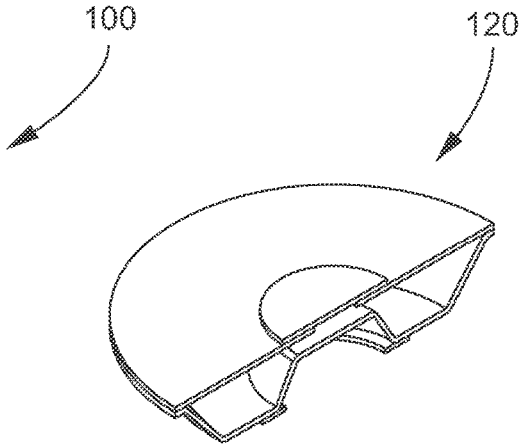
FIG. 15 is a cutaway, perspective view of an end igniter container in the module of FIG. 14.

FIG. 14 is a cutaway, perspective view of a variation of the MACS module 100 of FIG. 10. In FIGS. 14 and 15, the cap end igniter container 120 does not have channels 118. Similarly, the body end igniter container (not shown) in the variation of FIG. 14 does not have channels 118.

Figure 16:
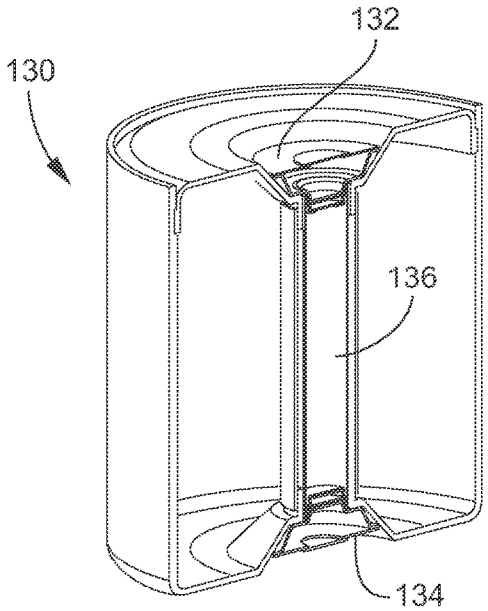
FIG. 16 is a cutaway, perspective view of another embodiment of a novel MACS module.

FIG. 16 is a cutaway, perspective view of another embodiment of a novel MACS module 130. Module 130 is similar in construction to module 50 of FIG. 2. In module 130, the geometry of the cap end and body end igniter containers 132, 134 has been altered, compared to the module 50 of FIG. 2, to increase the volume of the containers 132, 134. The core igniter container 136 is somewhat shorter, compared to the core igniter container of module 50.

Figure 17:
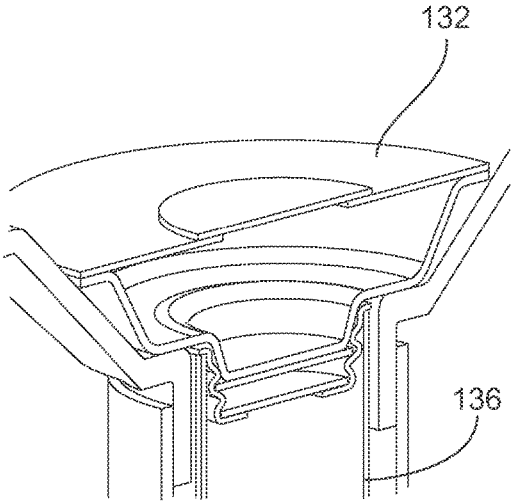
FIG. 17 is an enlarged view of a portion of FIG. 16.
Figure 18:
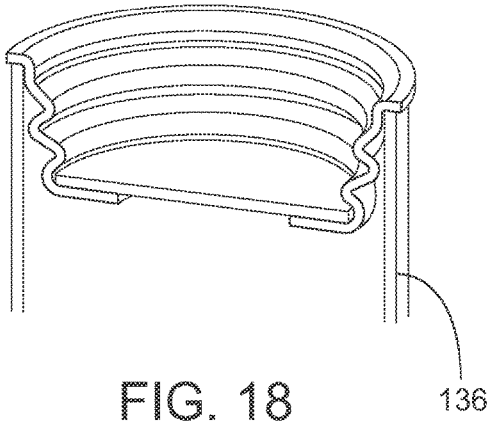
FIG. 18 is a cutaway, perspective view of the cap end of the core igniter container of the module in FIG. 16.
Figure 19:
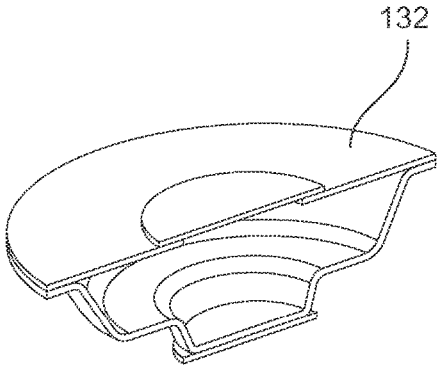
FIG. 19 is a cutaway, perspective view of an end igniter container of the module in FIG. 16.

FIG. 17 is an enlarged view of a portion of the module 130 of FIG. 16. FIG. 18 is a cutaway, perspective view of the cap end of the core igniter container 136 of the module 50 in FIG. 16. FIG. 19 is a cutaway, perspective view of the end igniter container 132 of the module 50 in FIG. 16.

The novel ignition containers reduce manufacturing variability, manufacturing steps and costs. The potential for injury is greatly reduced by eliminating the prior art manual sewing process. The novel ignition containers can be tailored or configured for multiple ignition processes. The Figs. depict ignition containers of various geometries, however, other geometries may also be used.

While the invention has been described with reference to certain embodiments, numerous changes, alterations and modifications to the described embodiments are possible without departing from the spirit and scope of the invention as defined in the appended claims, and equivalents thereof.

What is claimed is:

1. An artillery charge system module having a central longitudinal axis, comprising:

a hollow, cylindrical combustible body having an open end and a closed end with a center hole, the closed end of the body at the center hole having a conical surface joined to a flat surface joined to a tubular surface;

a core tube having first and second open ends and centered on the central longitudinal axis;

a hollow, cylindrical, combustible cap having an open end and a closed end with a center hole, the open end of the cap being concentrically attached to the open end of the body, the closed end of the cap at the cap center hole having a conical cap surface joined to a flat cap surface joined to a tubular cap surface;

a rigid, core igniter container disposed in the core tube;

a rigid, body end igniter container disposed in the closed end of the body in juxtaposition with the conical surface; and a rigid, cap end igniter container disposed in the closed end of the cap in juxtaposition with the conical cap surface;

wherein the cap end and body end igniter containers are fixed to the core igniter container.

2. The module of claim 1, wherein the core igniter container, cap end igniter container and body end igniter container are made of foamed celluloid.

3. The module of claim 2, wherein the core igniter container is a rigid tube having a cap end and a body end and internal surfaces of the core igniter container at the cap end and the body end include ridges.

4. The module of claim 3, wherein the body end and cap end igniter containers each have a large container portion and a small container portion that extends from the large container portion into a respective end of the core igniter container, the small container portion including a flange that mechanically locks beneath the ridges in the internal surfaces of the core igniter container.

5. The module of claim 3, wherein a plug is inserted in each end of the core igniter container, the plug having a receptacle for receiving the small container portion of the end igniter containers and further wherein the ridges are formed on the receptacle.

6. The module of claim 3, wherein the body end and cap end igniter containers each have a propellant loading hole and a closure for the propellant loading hole.

7. The module of claim 6, wherein the closures are made of a transparent material.

8. The module of claim 7, wherein the transparent material is unfoamed celluloid sheet.

9. The module of claim 5, wherein at least one of the plugs inserted in the core igniter container includes a propellant loading hole and a closure for the propellant loading hole.

10. The module of claim 4, wherein the core igniter container is a circular tube.

11. The module of claim 10, wherein the large container portion is a conical frustum and the small container portion is tubular.

12. The module of claim 4, wherein at least one of the body end and cap end igniter containers includes a radial slot formed therein, the slot extending radially inward from an outer edge of the one of the body end and cap end igniter containers.

13. The module of claim 12, wherein the core igniter container is a rectangular tube and includes a longitudinal pocket formed on one side.

14. The module of claim 13, wherein a temperature probe is inserted in the radial slot and in the longitudinal pocket.

15. The module of claim 1, wherein the body end and cap end igniter containers are each generally frusto-conical in shape and include a receptacle on a side facing the core igniter container and a flange that extends around and partially into the receptacle.

16. The module of claim 15, wherein the core igniter container is a rigid tube having a cap end and a body end and external surfaces of the core igniter container at the cap end and the body end include ridges.

17. The module of claim 16, wherein the cap and body ends of the core igniter container extend into the receptacles of the cap end and body end igniter containers, respectively, and the flanges on the cap and body end containers mechanically lock in the ridges on the external surface of the core igniter container.

18. The module of claim 17, wherein sides of the cap end and body end igniter containers opposite the core igniter container have channels formed therein.

19. The module of claim 16, wherein one of the cap end and the body end of the core igniter container includes a propellant loading hole and a closure for the propellant loading hole.

20. The module of claim 2 wherein the core igniter container comprises a longitudinal tube with opposing ends and a plug inserted in each opposing end, the plug having a receptacle with ridges on the interior of the receptacle; and wherein the cap end igniter and body end igniter container comprises a large container portion and a small container portion, said small container portion extends from the large container portion into the receptacle of a respective plug; and the small container portion including a flange that mechanically locks beneath the ridges in the interior of the receptacle, and wherein each end of the igniter container having a propellant loading hole and a closure for the propellant loading hole.

* * * * *